United States Patent [19]

Heller

[11] 4,082,577

[45] Apr. 4, 1978

[54] PROCESS FOR THE HEAT TREATMENT OF STEEL

[75] Inventor: Wilhelm Heller, Rheinhausen, Germany

[73] Assignee: Fried. Krupp Huttenwerke AG, Bochum, Germany

[21] Appl. No.: 604,862

[22] Filed: Aug. 14, 1975

[30] Foreign Application Priority Data

Aug. 16, 1974 Germany ..... 2439338

[51] Int. Cl.[2] ..... C21D 9/04

[52] U.S. Cl. ..... 148/12.1; 148/18; 148/36; 148/39; 148/134

[58] Field of Search ..... 148/134, 143, 146, 152, 148/18, 12.1, 12.4, 36, 39

[56] References Cited

U.S. PATENT DOCUMENTS

| | | | |
|---|---|---|---|
| 1,178,352 | 4/1916 | Sandberg | 148/152 |
| 1,205,998 | 11/1916 | Kenney | 148/143 |
| 3,519,497 | 7/1970 | Pomey | 148/134 |

*Primary Examiner*—R. Dean

*Attorney, Agent, or Firm*—Burgess, Dinklage & Sprung

[57] ABSTRACT

A process for the heat treatment of a steel rail which is at a temperature which is in the austenite range which comprises quenching at least the head portion of said rail in water maintained at a temperature of at least 80° C until the temperature of said rail is such that said rail has completed the pearlite transformation and recovering a rail whose steel composition is characterized by such a fine pearlitic structure that it cannot be resolved by a light microscope but is not bainitic in structure.

15 Claims, 3 Drawing Figures

COOLING CURVES

1 RAIL FOOT EDGE AND MIDDLE
2 RAIL HEAD EDGE
3 RAIL HEAD MIDDLE
4 RAIL HEAD EDGE (ON COOLING BED)

IN BOILING WATER

COOLING OF RAILS

PROFILE UIC 60

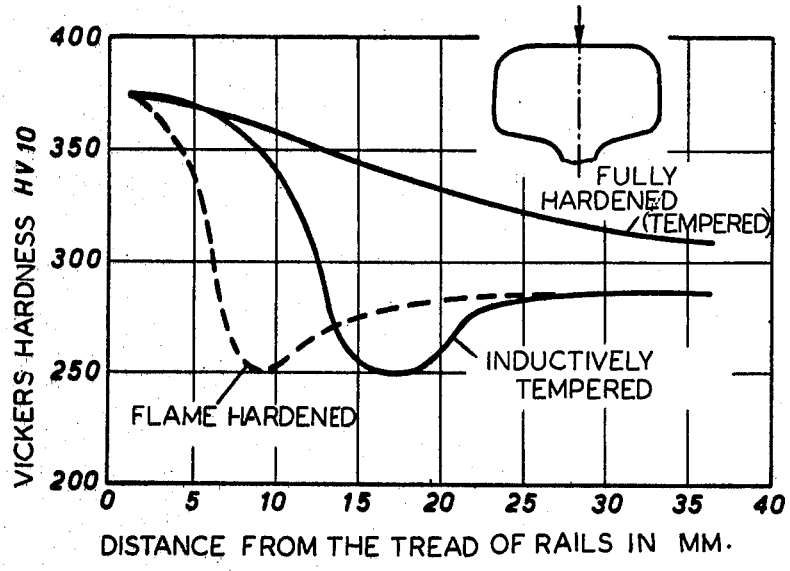
Fig.1 HARDNESS CURVE AT HEAT TREATED U.S. RAILS

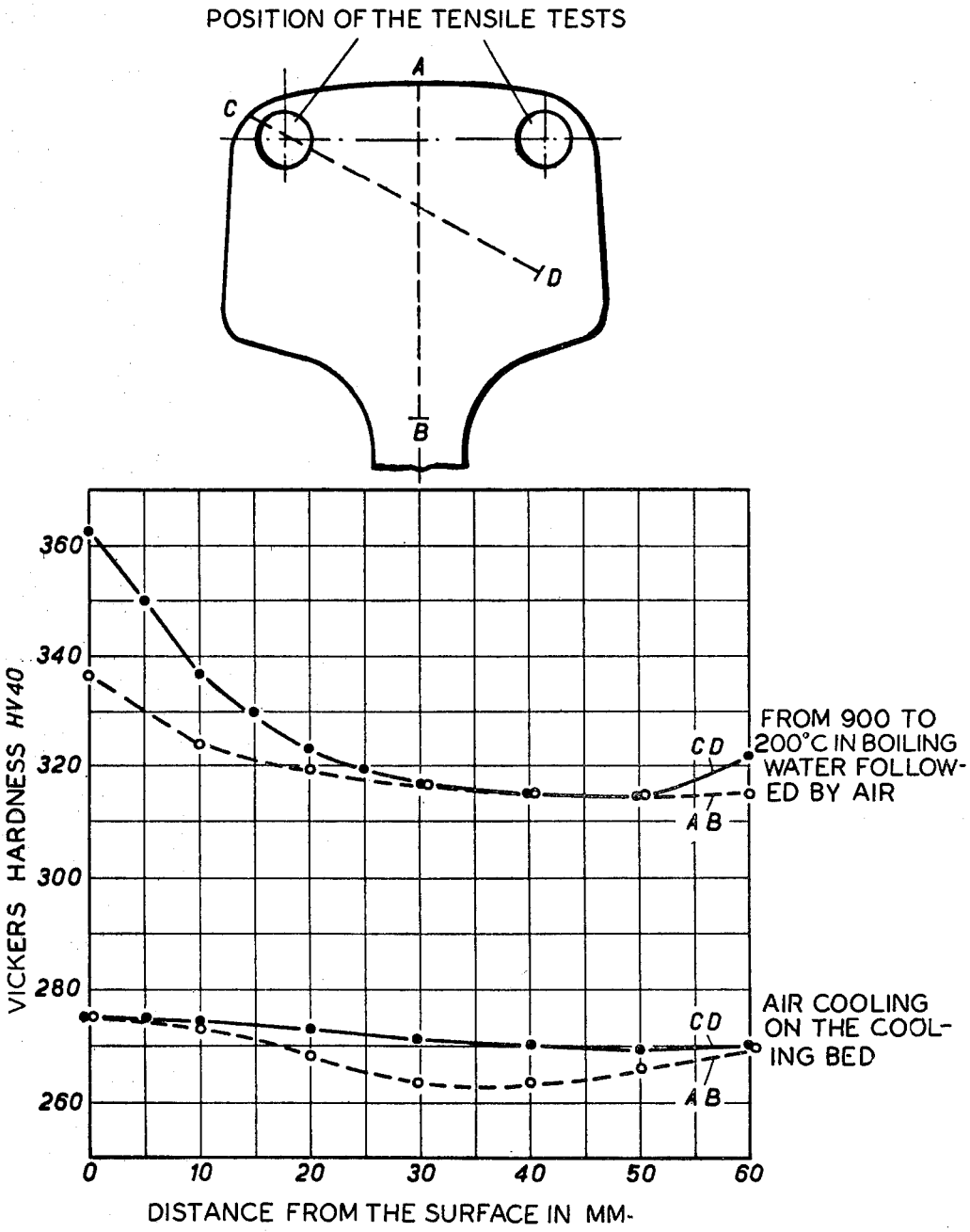
Fig.2 HARDNESS CURVE OF A RAIL AFTER AIR COOLING AND QUENCHING IN BOILING WATER
(0.75% C 0.25 % Si 1.03% Mn)

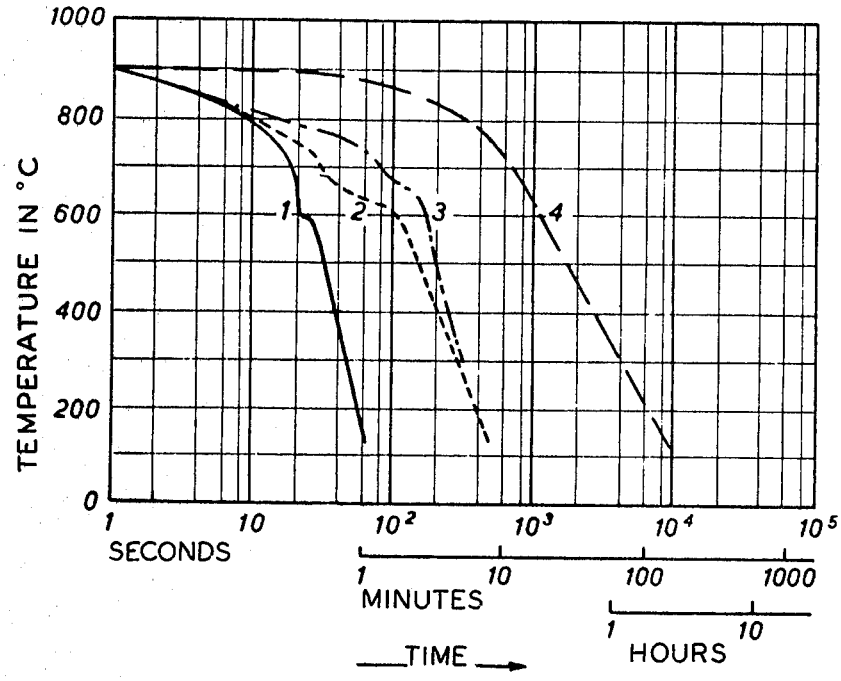
COOLING CURVES
1 RAIL FOOT EDGE AND MIDDLE
2 RAIL HEAD EDGE
3 RAIL HEAD MIDDLE
4 RAIL HEAD EDGE (ON COOLING BED)
} IN BOILING WATER
Fig.3 COOLING OF RAILS PROFILE UIC 60

PROCESS FOR THE HEAT TREATMENT OF STEEL

BACKGROUND OF THE INVENTION

1. Field of the Invention

This invention relates to a process for the heat treatment of a steel rail. More particularly, it relates to a process for cooling steel rails in heated condition whereby there is obtained a steel rail having improved hardness. This invention is particularly directed to a process for the preparation of steel rails characterized by high hardness, which steels do not contain substantial quantities of alloying elements. This invention is particularly concerned with the preparation of steel rails involving the quenching of steel rails in heated condition employing water at a temperature of at least 80° C.

2. Discussion of the Prior Art

Present-day standard rails employed in the railroad industry are naturally hard rails which, after rolling, are cooled on a cooling bed in motionless air. Alternatively, they can be cooled utilizing a delaying action in order to avoid flaking in cooling pits or carriages. See "Stahl and Eisen", 81, pages 1253–1263 (1961).

In accordance with the "Technical Delivery Conditions of the International Railway Union UIC 860-V", these rails should have a minimum tensile strength of 686 or 882 N/mm$^2$, respectively. As the reference or guide analyses in Table 1 below show in respect of Examples 1 to 3, the carbon and manganese are the main components which impart strength. The structure of these rails is pearlitic-ferrite for Example 1 and pearlitic for Examples 2 and 3.

Because of increasing traffic employing the rails and partly in conjunction with the fact of higher axle loads being experienced, there is a need for higher strength rails. Specifically, there is a need to provide steel rails having a minimum tensile strength of 1080 N/mm$^2$ which corresponds to a minimum tensile strength of 110 kp/mm$^2$. See "Krupp Technical Reports 32" (1974) Volume 1.

Unfortunately, this kind of strength can no longer be obtained employing the naturally hard carbon-manganese steels. It has been required to include alloying elements in the steel such as chromium, vanadium and molybdenum. As seen in Table 1, Example 4 below, such a steel having a silicon content can be employed which will raise the rail hardness to at least 882 N/mm$^2$ minimum tensile strength where the steel additionally contains approximately 1% chromium. However, even this improved tensile strength is insufficient in many circumstances, for the rails should be characterized by a minimum tensile strength of at least 1080 N/mm$^2$.

The use of relatively high alloy contents and additional alloying elements adds to the expense of the rails and involves certain special welding techniques. Additionally, since in continuously welded railway tracks more than 50% of all of the rail damage and fractures occurs at the weld (see "Eisenbahntechnische Rundschau" 22 (1973), Volume 6) the suitability of such a rail of such a composition is in doubt owing to its high alloy content. With a view to advantageous suitability for welding, it is desirable to provide a steel rail having high strength values which has as low an alloy content as possible. It is the alloy content which provides problems in the welding of the steels together and which increases the likelihood of rail damage at the welds.

Thus, attention has been directed to various rail heat treatments as an answer to the problem of providing higher tensile strength steel rails.

Methods which have been normally been used for the heat treatment of rails involve the cooling of the heated rails, after welding, with some delay in static air or in pits. Thereafter, they can be treated in one of two basic manners. In one process following straightening, they are austenitized in batches in a furnace and then quenched in oil and furnacetempered. In such a case the entire cross section is treated (full quench and temper treatment). In another manner following straightening, the rails are heated with burners or inductively in a continuous process and then the rails are quenched with sprays and tempered. See "Stahl and Eisen" 90 (1970) pages 922, 928. This latter continuous throughflow method is used almost exclusively for the heat treatment of the rail head or partial regions of the rail head, i.e., the entire cross section of the rail is not so treated. The rail web and the rail base are left in the as-rolled state.

In the heat treatment involving the quenching in oil, a fine pearlitic structure is produced. Continuous throughflow methods in some cases work towards a pearlitic structure and to some extent towards a quenched or tempered structure. FIG. 1 of the accompanying drawings shows the hardening curves with respect to the distance from the running surface of a heat treated American (U.S.) rail which has been subjected to full quench and temper treatment, flame hardening and quench and temper treatment using the inductive method. An important difference lies in the fact that with quench and temper treatment, the hardness only decreases gradually towards the interior of the rail head and in all cross-sectional regions is higher than in the as-rolled state. For the flame-hardened and inductively hardened rails, the decrease in hardness is initially more abrupt, the hardness curve passing through a valley which is below the hardness for the as-rolled state. If there is not sufficiently deep heat treatment, there is a risk that with greater hardness in the running surface region below the running surface in the region of the high shearing stresses, there will be inadequate strength values. Obviously, these methods are characterized by certain disadvantages involving substantial additional expense for the renewed heating of the rails. In addition, these methods are not suitable for heat treatment on a large industrial scale and thus, cannot be used adequately as cooling means for the high output of a rail rolling mill.

Earlier recommended heat treatment for rails from rolling heat advocated the cooling of the rails with accelerated cooling employing short-duration immersion of the rail head in a bath of water or cooling by spraying the rail head with atomized water, steam or damp compressed air until the red heat disappeared. In such a case, the rail head and the rail base had to be protected before cooling. Such a process has not been adapted successfully on a large industrial scale. Details of such process are reported in the "3rd International Rail Conference of 8–12 September 1935, Hungarian Association for Material Testing Budapest, 1936." In addition to the obvious disadvantages in the earlier processes recommended, processing difficulties and uncertainties in respect of heat treatment provided by variations in the initial temperature of the steel, the quantity of the water and the duration of hardening presented obstacles to the acceptable utilization of such a process in production.

In addition to the other known methods (again as reported in the "3rd International Rail Conference Budapest") a process for the treatment of a rail head was proposed involving intermittent hardening by repeated short-duration dipping in the lifting and lowering hardening bath until the red heat of the steel disappeared (Nueves Maisons method). Alternatively, the rail head can be held in the water bath without interruption to $\frac{2}{3}$ to $\frac{3}{4}$ of its height (Maximilianshutte method). Both methods were technically quite involved and have been abandoned.

In a Polish proposal (again see the "3rd International Rail Conference Budapest") rails were conducted, standing or lying, at any desired speed through a heat treatment installation, the surfaces intended for heat treatment being sprinkled with atomized water. Other surfaces were protected from accelerated cooling. Hardening of the rail to beyond 300° Brinell was regarded as undesirable because of the danger of flaking. For reasons of process technique, this method was not very suitable for processing rails at high output rate.

It therefore became desirable to provide a commercially and technically feasible and sound process for the heat treatment of steel rails. More particularly, it became desirable to provide a process for the heat treatment of rails wherein the rails would acquire a superior tensile strength, particularly at the rail head. More especially, it became desirable to provide such a process which could improve the tensile strength of the rail head without the use of substantial quantities of alloying elements.

SUMMARY OF THE INVENTION

The desires felt in the steel rail industry are answered, in accordance with this invention, which provides a process for the heat treatment of a steel rail which is at a temperature which is in the austenite region, which process comprises quenching at least the head portion of said rail in water maintained at a temperature of at least 80° C until the temperature of said rail is such that said rail has completed the pearlitic transformation and recovering a rail whose steel composition is characterized by such a very fine pearlitic structure that it cannot be resolved by a light microscope but is not bainitic in structure.

In accordance with the present invention, it has been found that if a steel rail is quenched entirely or at at least its head portion from a temperature above the $\gamma$-$\alpha$ transformation point (preferably 800° to 850° C) in boiling water or in water which is virtually boiling (at least 80° C) and if the steel is maintained in contact with such water until the pearlite transformation is completed, the steel rail composition is characterized by steel having a very fine pearlitic structure which is not bainitic. By the term "very fine pearlitic structure" there is meant steel which cannot be resolved by a light microscope but is not bainitic in structure. An older definition for this very fine structure is troostite. On the contrary, a "fine pearlitic-structure" can still be resolved by a light microscope.

Generally speaking, the steel rails treated in accordance with the invention are quenched while they are at a temperature in the range of about 790° to 870° C, preferably 800° to 850° C, employing boiling water or water whose temperature is at least 80° C. The water is maintained in contact with the steel rail until a temperature is reached at which the pearlite transformation is complete. Generally, this temperature is between 100° C and 470° C, preferably 100° to 200° C. In any event, the composition of the steel assumes a very fine pearlitic but non-bainitic structure.

It has been found that steel rails having such a composition have a minimum tensile strength of at least 1080 $N/mm^2$ (110 $kp/mm^2$), preferably a tensile strength of at least 1.175 $N/mm^2$. With these properties, the rail steel is eminently suited for use in railroads where heavier axle loads will occur. Moreover, these steels have improved tensile strength without including in the steel composition itself significant quantities of alloying elements. In fact, by the process of the invention, there can be produced steels having tensile strengths which meet these requirements which do not include alloying elements.

BRIEF DESCRIPTION OF DRAWINGS

Referring to the drawings herein,

FIG. 1 is a curve which plots the Vickers hardness against the distance from the tread of a rail and shows the Vickers hardness of a fully hardened (tempered) rail, a flame hardened rail, and an inductively tempered rail. It is seen that except for the fully hardened rail, the hardness values drop sharply as the distance from the tread of the rails increases;

FIG. 2 shows a typical cross section of a head portion of a steel rail and also depicts a graph which plots the Vickers hardness against the distance from the surface of the rail. The data set forth in graphical form therein shows the higher Vickers hardness of a steel rail hardened from 900° C to 200° C in boiling water (according to the invention) against a steel rail hardened by air cooling employing a cooling bed; and FIG. 3 is a graph which plots temperature against cooling time for various rail sections and demonstrates that the method of the invention will more rapidly cool a rail head edge.

DESCRIPTION OF SPECIFIC EMBODIMENTS

In a preferred embodiment of the invention, the steel rails are cooled well below the temperature at which pearlitic transformation has occurred and are cooled to a temperature below 100° C. In this way the already considerable increase in productivity is augmented. By leaving the steel rails in the quenching medium, cooling is accelerated to 100° C.

The invention can be more readily understood when reference is made to the drawings herein. Referring to FIGS. 2 and 3, showing respectively the hardness pattern of a rail of the head profile shown after air cooling and quenching water employing a rail steel whose hardness components comprise 0.75% carbon, 0.25% silicon and 1.03% manganese and the cooling of a rail having profile UK 60. In FIG. 3, curve 1 shows the cooling, according to the invention, of a rail base edge and a rail center section. By use of boiling water or water of temperature at least 80° C, the rail base edge and middle section are rapidly cooled within about 1 minute from 850° C to between 100° and 200° C. The rail head edge is cooled in a similarly short period of time reaching a temperature between 100° and 200° C after about 9 minutes. Curve 3 shows the cooling of the rail of the middle portion of the rail head which is cooled at virtually the same rate as the rail head edge. However, when a rail is treated by cooling employing a cooling bed, the cooling takes a substantially longer period of time and follows curve 4, the temperature of 100°-200° C being reached only after about 2 hours have elapsed. Moreover, temperatures of 400° C can be reached in a short period of time of about 40 seconds almost independently of the rail profile. With manganese content values above 1.4%, it can be expected that martensite fractions will appear.

If the cooling is limited to the rail head, one can employ steels having higher alloy content and thus achieve higher strength values as shown in FIG. 2. According to the cooling curve 2 which applies to the rail head edge in FIG. 3, manganese content values of up to 1.8% or a combination of alloying elements with these specified cooling conditions can be provided to result in a pearlite transformation. Thus, higher alloy contents can be employed to provide steels having a high Vickers hardness.

The cooling in water of the invention not only provides superior rails, but also serves to augment the capacity of a given plant so as to increase the hot bed capacity therein. Whereas according to curve 4 of FIG. 3 rails can be cooled in about 3 hours to 110° C after rolling, this time can be reduced to about 10 minutes when the rails are cooled by quenching in boiling water.

The process for quenching complete rails in boiling water or approximately boiling water (at least 80° C) can be used on a wide variety of rails, particularly those whose analysis is set forth in Table 1 below. It will be realized that the table sets forth only those components which provide the strength and that the balance of the rail composition is iron with the usual impurities. It is also observed that with the present invention, further alloying elements can be employed provided that they do not delay the end of the pearlite transformation. The manganese content can be replaced by other elements in quantities which are equivalent with respect to the pearlite transformation. Thus, manganese can be replaced by other elements which include:

TABLE 1

GUIDE ANALYSIS FOR RAIL STEELS IN % BY WEIGHT

| Example $\sigma B$ N/mm² | STEEL COMPOSITION STRENGTH COMPONENTS C | Si | Mn | Cr |
|---|---|---|---|---|
| 1 686–833 | 0.40–0.60 | ≦0.35 | 0.80–1.20 | — |
| 2 ≧ 882 Quality A | 0.60–0.75 | ≦0.5 | 0.80–1.30 | — |
| 3 ≧ 882 Quality B | 0.50–0.70 | ≦0.5 | 1.30–1.70 | — |
| 4 ≧ 1080 | 0.65–0.80 | 0.60–0.90 | 0.80–1.30 | 0.80–1.30 |
| 5 — | 0.40–0.90 | ≦1.30 | 0.60–1.40 | — |
| 6 ≧ 1175* | 0.75–0.85 | ≦0.50 | 0.90–1.10 | — |
| 7 ≧ 882* | 0.45–0.55 | ≦0.50 | 0.70–0.90 | — |
| 8 ≧ 686* | 0.40–0.50 | ≦0.30 | 0.60–0.80 | — |

*running surface strength

Cooling in water, according to the invention, provides a very fine pearlitic structure which is uniform over the entire rail cross section in spite of the very considerable cross section variations between the rail base and the rail head. The pearlitic structure has good stability in contrast to what is provided by known procedures. The rail is suitable for subsequent welding and does not require any special welding techniques.

Referring to FIG. 2, there are shown therein comparative curves for the Vickers hardness of a rail obtained by cooling in boiling water followed by air treatment, in accordance with the invention, versus treatment of a rail by air cooling on a cooling bed. The rail treated, whose hardness values are reported in FIG. 2, is one having the chemical composition given under No. 1 in Table 2 below. It will be observed that the rail treated in accordance with the invention had a considerable hardness in the region of the rail head, particularly at the surface. The hardness does not substantially diminish as the distance from the surface of the rail increases. The rail has a hardness in excess of 300 HV which distinguishes the steel rails of the invention over prior art steel rails. Thus, whereas the prior art treated steel rails have a hardness of about 275 HV, the rails of the invention have a hardness of 320 to 360 HV ($\delta_B \geqq 1080$ N/mm²). The increased hardness found toward the running edge (line CD) is of particular significance, since the highest wearing and fatigue stresses occur along this line.

TABLE 2

COMPOSITION OF TEST RAILS IN % BY WEIGHT

| rail | profile | C | Si | Mn | P | S |
|---|---|---|---|---|---|---|
| 1 | UIC 60 | 0.75 | 0.25 | 1.03 | 0.040 | 0.017 |
| 2 | S 49 | 0.75 | 0.27 | 1.04 | 0.016 | 0.017 |

Tensile stresses on cylindrical samples having a diameter of 10 mm taken from the rail head at the running edge in accordance with FIG. 2 in the longitudinal direction gave, for two rails having the chemical composition indicated in Table 2 above, the values which are together depicted in Table 3 below for the as-rolled state and for quenching in boiling water.

TABLE 3

MECHANICAL PROPERTIES AFTER VARIOUS KINDS OF COOLING

| rail | type of cooling | $\sigma_S$ in N/mm² | $\sigma_B$ | $\sigma_R$ | $\delta_S$ in % | $\Psi$ |
|---|---|---|---|---|---|---|
| 1 | water | 656 | 1080 | 1370 | 12.5 | 29 |
| 2 | air | 510 | 960 | 1194 | 12.5 | 25 |
| 2 | water | 666 | 1080 | 1390 | 14 | 32 |
| 2 | air | 500 | 942 | 1175 | 14 | 26 |

$\sigma_S$ = yield point
$\sigma_B$ = tensile strength
$\sigma_R = \frac{\text{breaking stress}}{\text{breaking cross-section}}$ $\delta_S$ = elongation at fracture
$\Psi$ = reduction area Thus, by the present cooling technique the following mean improvements in properties are achieved with the same elongation at fracture:

| | | |
|---|---|---|
| Tensile strength | 127 N/mm² | (13%) |
| Yield point | 157 N/mm² | (30%) |
| Tearing strength | 196 N/mm² | (16%) |
| Cross section reduction at fracture | 5% | (20%) |

In rail impact tests in accordance with UIC conditions, there was observed no difference between hot bed cooling and boiling water cooling in respect of the number of impacts which the rail would tolerate. In accordance with UIC requirements, the rails must withstand two impacts. Both rails broke at the fourth or fifth impact. Despite the higher strength values the heat treatment does not substantially adversely affect the toughness. Judging from the data on the reduction of area upon fracture, the toughness is generally improved by the treatment of the invention.

As indicated above, the strength values are considerably improved. Since in tensile tests the lower regions of the rail head were comprehended to a depth of 15 mm, an even more marked improvement in the strength values is to be expected as the distribution of hardness values shows in the more interesting region near the surface. Hardness values of 325 to 360 HV at 10 mm depth or at the surface are associated with tensile strength values of 1175 and 1300 N/mm$^2$, respectively, and with an observed yield point relationship of 0.60, yield point values of 705 and 794 N/mm$^2$. Thus, as compared with rails of good wearing strength with minimum strength of 882 N/mm$^2$, the working life can be expected to be at least double in respect of wear and fatigue stresses.

Alternatively, if hardening beyond 320 HV is unnecessary, quenching in boiling water permits one to obtain the present-day minimum tesile strength values of standard rails with lower alloy contents than heretofore employed, which rails have improved weldability.

To provide steel rails with hardness above 320 HV in the region of the running surface, it is preferred to use a steel composition whose restricted analysis is shown in Table 1. Particularly preferred is the steel of Table 1, Example No. 6.

Rails with running surface strength values in accordance with UIC conditions of above 882 or 686 N/mm$^2$, as appropriate, but with improved welding suitability can be produced by steels whose analysis is given in Table 1, Examples Nos. 7 and 8.

Preferably, the rail steels are low in hydrogen. For example, in the case of a single-heat rolling they are to be melted or cast with a low-hydrogen method, for example, one involving degasification under a vacuum whereby a steel of low hydrogen content is realized. With two-heat rolling it is possible to obtain a low hydrogen content by delayed cooling of the blooms.

In addition to quality improvement, advantages of the present process include substantial savings in processing, such as realized by reduction in alloy expenses as compared with naturally hard rails and the dispensation of preliminary straightening and re-heating owing to working from rolling heat, which fits easily into the rolling rhythm. Simple manipulation is provided by the present process compared with other heat treatment methods of the prior art.

The quenching can also be carried out on rails which have been initially normally cooled, straightened and then austenitized again.

An example of operation from ingot to rail appears in practice as follows:

The ingots produces for the manufacture of rails of the type UIC 60 (for analysis see table 2, page 13) have a weight of approximately 7 t (70 kg Newton) and a height of approximately 2500 mm; it concerns normal conical ingots measuring 690 × 690 mm at the bottom and 600 × 600 mm at the top. The chemical compositions of such an ingot by means of example amounts (in percentage by weight) to:

0.70 to 0.76% carbon
0.15 to 0.30% silica
0.90 to 1.10% manganese
max. 0,040% phosphorous
max. 0.040% sulfur
remainder iron.

These ingots are placed in heating furnaces to be heated at approximately 1.250° C for approximately 4 hours. After this time, during which a thoroughly uniform temperature is aimed at, the ingots are drawn out with a stripper crane and conveyed over a roller transporter to the blooming mill, where they are rolled in 19 passes to a cross-section of 200 × 310 mm.

The rolled ingot at a temperature of approximately 1.200° C is conveyed to the rail rolling mill over a subsequent roller. The rolled ingot is here rolled in a total of 11 passes between rollers with a diameter of approximately 850 mm, which are provided with grooves necessary for the desired rail type. The rail which is completely rolled still has a temperature of approximately 1.080° C. It is sawn into sections of corresponding lengths at approximately 950° C. After air cooling at between 800° and 850° C the rail is quenched from this temperature in boiling water and held there until a temperature of approximately 150° C is reached. This quenched rail has mechanical properties as specified on page 14 in table 3, line 14 (Steel UIC 60).

What is claimed is:

1. A process for the heat treatment of a steel rail which is at a temperature which is in the austenite range, which process consists essentially of quenching at least the head portion of said rail in boiling water, maintaining the rail in said water until it reaches a temperature of 100° C and recovering a rail whose steel composition is characterized by such a very fine pearlitic structure that it cannot be resolved by a light microscope but is not bainitic in structure.

2. A process according to claim 1 wherein the rail is quenched at a temperature of 800° to 850° C.

3. A process according to claim 1 wherein quenching is carried out from rolling heat.

4. A process according to claim 1 wherein the rail contains manganese whose quantity is limited so that the production of martensite fractions at the rail base edge is obviated.

5. A process according to claim 1 wherein the steel comprises 0.4 to 0.60% carbon, up to 0.35% silicon, 0.80 to 1.20% manganese, the remainder being iron with the usual impurities.

6. A process according to claim 1 wherein the rail steel has a composition comprising 0.60 to 0.75% carbon, up to 0.5% silicon, 0.80 to 1.30% manganese, the remainder being iron with the usual impurities.

7. A process according to claim 1 wherein the rail steel has a composition comprising 0.50 to 0.70% carbon, up to 0.5% silicon, 1.30 to 1.70% manganese, the balance being iron with the usual impurities.

8. A process according to claim 1 wherein the steel has a composition comprising 0.65 to 0.80% carbon, 0.60 to 0.90% silicon, 0.80 to 1.30% manganese, 0.80 to 1.30% chromium, the balance being iron with the usual impurities.

9. A process according to claim 1 wherein the rail steel has a composition comprising 0.40 to 0.90% carbon, up to 1.30% silicon, 0.60 to 1.40% manganese, the balance being iron with the usual impurities.

10. A process according to claim 1 wherein the rail steel has a composition comprising 0.75 to 0.85% carbon, up to 0.50% silicon, 0.90 to 1.10% manganese, the balance being iron with the usual impurities.

11. A process according to claim 1 wherein the rail steel has a composition comprising 0.45 to 0.55% carbon, up to 0.50% silicon, 0.70 to 0.90% manganese, the balance being iron with the usual impurities.

12. A process according to claim 1 wherein the rail steel has a composition comprising 0.40 to 0.50% carbon, up to 0.30% silicon, 0.60 to 0.80% manganese, the balance being iron with the usual impurities.

13. A process according to claim 1 wherein the steel composition is free of any alloying elements.

14. A process according to claim 1 wherein after said steel rail has been cooled to a very fine pearlitic structure it is thereafter cooled in air.

15. A process according to claim 1 wherein the rail is introduced into the bath of boiling water until the rail has completed the pearlitic transformation.

* * * * *